United States Patent [19]

Kubota et al.

[11] Patent Number: 4,582,779

[45] Date of Patent: Apr. 15, 1986

[54] INTERNAL LATENT IMAGE-TYPE DIRECT POSITIVE SILVER HALIDE EMULSIONS AND PHOTOGRAPHIC MATERIALS

[75] Inventors: Satosi Kubota; Tadao Sugimoto, both of Kanagawa, Japan

[73] Assignee: Fuji Photo Film Co., Ltd., Kanagawa, Japan

[21] Appl. No.: 625,743

[22] Filed: Jun. 28, 1984

[30] Foreign Application Priority Data

Jun. 29, 1983 [JP] Japan ..... 58-117768

[51] Int. Cl.[4] ..... G03C 5/24

[52] U.S. Cl. ..... 430/409; 430/410; 430/598; 430/940; 430/592

[58] Field of Search ..... 430/940, 592, 409, 410, 430/598

[56] References Cited

U.S. PATENT DOCUMENTS

| | | | |
|---|---|---|---|
| 3,736,145 | 5/1973 | Hirata et al. | 430/592 |
| 3,772,030 | 11/1973 | Gilmar et al. | 430/940 |
| 3,865,596 | 2/1975 | Furuya et al. | 430/592 |
| 4,263,397 | 4/1981 | Horikoshi et al. | 430/592 |
| 4,266,003 | 5/1981 | Ikeda et al. | 430/592 |

FOREIGN PATENT DOCUMENTS

| | | | |
|---|---|---|---|
| 57-79940 | 5/1982 | Japan | 430/940 |

*Primary Examiner*—Won H. Louie

*Attorney, Agent, or Firm*—Sughrue, Mion, Zinn, Macpeak and Seas

[57] ABSTRACT

A previously unfogged internal latent image-type direct positive silver halide emulsion and a photographic material incorporating such emulsion are described, wherein the emulsion contains at least one sensitizing dye represented by formula (I):

(I)

wherein one of $R^1$ and $R^2$ represents a sulfoalkyl group and the other thereof represents an unsubstituted or substituted alkyl group, an unsubstituted or substituted aryl group, or a pyridyl group; X represents a sulfur atom or an oxygen atom; Y represents a sulfur atom, an oxygen atom, or wherein R represents a lower alkyl group or $-(CH_2)_{n_1}O-(CH_2)_{n_2}OH$, wherein $n_1$ and $n_2$ each represents an integer of 1 to 4; and W represents a hydrogen atom, a halogen atom, a lower alkyl group, a lower alkoxy group, or an unsubstituted or substituted phenyl group.

17 Claims, No Drawings

INTERNAL LATENT IMAGE-TYPE DIRECT POSITIVE SILVER HALIDE EMULSIONS AND PHOTOGRAPHIC MATERIALS

FIELD OF THE INVENTION

This invention relates to a previously unfogged internal latent image-type silver halide emulsion, and more particularly to a spectrally sensitized internal latent image-type silver halide emulsion and photographic material which are useful for obtaining direct positive images by processing the silver halide emulsion with a surface developer in the presence of a fogging agent.

BACKGROUND OF THE INVENTION

A process for obtaining direct positive images by processing an internal latent image-type silver halide photographic emulsion with a surface developer in the presence of a fogging agent, as well as silver halide photographic emulsions and light-sensitive materials for such a process, are known, as disclosed for example, in U.S. Pat. Nos. 2,456,953, 2,497,875, 2,497,876, 2,588,982, 2,592,250, 2,675,318, and 3,227,552, British Pat. Nos. 1,011,062 and 1,151,363, Japanese Patent Publication No. 29405/68, etc.

By the expression "internal latent image-type silver halide photographic emulsion" is meant a silver halide photographic emulsion which has photosensitive centers mainly inside of the silver halide grains, and a latent image is formed inside of the silver halide grains due to such photosensitive centers. A silver halide photographic emulsion composed of such silver halide grains is not substantially developed by a surface developer.

By the expression "surface developer" herein is meant a developer which develops a surface latent image formed on silver halide grains, but which does not substantially develop an internal latent image. Such a surface developer or surface developer composition typically contains a conventional silver halide developing agent, but must substantially not contain a silver halide solvent (e.g., a water-soluble thiocyanate, a water-soluble thiosulfate, ammonia, etc.) which is used for developing an internal latent image of silver halide grains. The surface developer may contain a small amount of excess halide, or such excess halide may be present in a silver halide emulsion layer in the form of a halide-releasing compound. However, the use of a large amount of a halide must usually be avoided, to prevent the occurrence of substantial decomposition or dissolution of silver halide grains.

In the above-noted process for obtaining direct positive images, the fogging agent may be present in a developer or in a silver halide photographic emulsion layer or other layer of a photographic material.

As a direct positive silver halide emulsion, a previously surface-fogged silver halide emulsion (i.e., a previously fogged-type direct positive silver halide emulsion) is well known in addition to an unfogged internal latent image-type direct positive silver halide emulsion which is developed in the presence of a fogging agent as described above. Also, it is well known that the silver halide emulsion of these previously fogged-type and unfogged-type can be spectrally sensitized by sensitizing dyes as described, for example, in U.S. Pat. No. 3,537,858, etc.

However, the process for forming images using an internal latent image-type direct positive silver halide emulsion (i.e., a direct positive silver halide emulsion which is surface-developed in the presence of a fogging agent) is utterly different from the process of forming images using a previously fogged-type direct positive silver halide emulsion. Thus, a sensitizing dye effective for the previously fogged direct silver halide emulsion is not always effective for the internal latent image-type direct positive silver halide emulsion. In the latter type silver halide emulsion, direct positive images are obtained by performing the surface development thereof in the presence of a fogging agent. In this case, there is an interaction between sensitizing dye and fogging agent, and the sensitizing dye frequently exhibits an action of accelerating or controlling the action of the fogging agent in addition to the essential sensitizing action.

This is described, for example, in *Research Disclosure*, No. 15162 (1976), page 78, lines 6 to 17, wherein it is noted that in the process for forming direct positive images using an internal latent image-type emulsion, negatively charged dyes, dyes having pair ions, and chargeless dyes are more effective than positively charged cyanine dyes, and among them, merocyanine dyes having a carboxy group as a substituent are particularly effective.

Also, in order to employ such process for obtaining direct positive images in the presence of a fogging agent for many photographic applications, improvement in the stability of the reversal photographic properties of the internal latent image-type direct positive silver halide emulsion layers with the passage of time during storage prior to development, and in particular the stability of the reversal photographic properties thereof in the case of storing them at high temperature and high humidity for a long period of time, has been desired.

Furthermore, if the developing temperature is high, there is a tendency that the change in photographic properties (sensitivity, $D_{min}$, gradation, etc.) exhibited due to the passage of time is relatively large as compared to the case of low temperature development, and hence improvement with respect to this point has also been desired.

SUMMARY OF THE INVENTION

One object of this invention, therefore, is to provide a color-sensitized internal latent image-type direct positive silver halide photographic emulsion having good reversal photographic properties and good stability with the passage of time.

Another object of this invention is to provide a color-sensitized internal latent image-type direct positive silver halide photographic emulsion exhibiting good reversal photographic properties even in high temperature development (i.e., higher than 35° C.).

The above-described objects of this invention can be attained by incorporating in a previously unfogged internal latent image-type direct positive silver halide emulsion, for use in a photographic material, at least one sensitizing dye represented by formula (I):

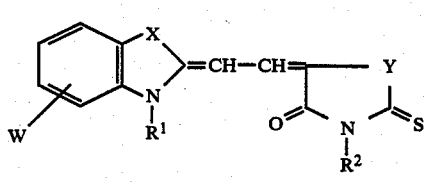

(I)

wherein one of $R^1$ and $R^2$ represents a sulfoalkyl group and the other thereof represents an unsubstituted or substituted alkyl group, an unsubstituted or substituted aryl group, or a pyridyl group; X represents a sulfur atom or an oxygen atom; Y represents a sulfur atom, an oxygen atom or $$-\underset{|}{N}-R,$$

wherein R represents a lower alkyl group or $-(CH_2)_{n_1}O-(CH_2)_{n_2}OH$, wherein $n_1$ and $n_2$ each represents an integer of 1 to 4; and W represents a hydrogen atom, a halogen atom, a lower alkyl group, a lower alkoxy group, or an unsubstituted or substituted phenyl group.

DETAILED DESCRIPTION OF THE INVENTION

The sensitizing dyes shown by formula (I) are described below in detail.

Examples of the sulfoalkyl group represented by one of $R^1$ and $R^2$ in formula (I) include a 2-sulfoethyl group, a 3-sulfopropyl group, a 3-sulfobutyl group, a 4-sulfobutyl group, a 2-hydroxy-3-sulfopropyl group, a 2-(3-sulfoethoxy)ethyl group, a 2-acetoxy-3-sulfopropyl group, a 3-methoxy-2-(3-sulfopropoxy)propyl group, a 2-[2-(3-sulfopropoxy)ethoxy]ethyl group, a 2-hydroxy-3-(3'-sulfopropoxy)propyl group, etc., and the sulfoalkyl groups having 4 or less carbon atoms are preferred. Among the above-illustrated groups, a 2-sulfoethyl group, a 3-sulfopropyl group, and a 4-sulfobutyl group give particularly preferred results.

The other of $R^1$ and $R^2$ represents an unsubstituted alkyl group (e.g., a methyl group, an ethyl group, a propyl group, a butyl group, etc.); a substituted alkyl group such as a hydroxyalkyl group (e.g., a 2-hydroxyethyl group, a 3-hydroxypropyl group, a 4-hydroxybutyl group, etc.), an aralkyl group (e.g., a benzyl group, a phenethyl group, a phenylpropyl group, a phenylbutyl group, a p-tolylpropyl group, a p-methoxyphenethyl group, a p-chlorophenethyl group, etc.), a carbamoylalkyl group (e.g., a carbamoylethyl group, etc.), a cyanoalkyl group (e.g., a cyanoethyl group, etc.); an unsubstituted or substituted aryl group (e.g., a phenyl group, a p-methoxyphenyl group, etc.); or a pyridyl group (e.g., a 2-pyridyl group, a 4-pyridyl group, etc.). Among them, unsubstituted or substituted alkyl groups (an alkyl group having 1 to 4 carbon atoms) and aryl groups are preferred and an ethyl group and a phenyl group give particularly preferred results.

X in formula (I) represents a sulfur atom or an oxygen atom.

Y represents a sulfur atom, an oxygen atom, or $$-\underset{|}{N}-R,$$

wherein R represents a lower alkyl group having from 1 to 4 carbon atoms (e.g., a methyl group, an ethyl group, etc.) or $-(CH_2)_{n_1}O-(CH_2)_{n_2}OH$, wherein $n_1$ and $n_2$ each represents an integer of 1 to 4.

W represents a hydrogen atom; a halogen atom (e.g., a fluorine atom, a chlorine atom, a bromine atom, an iodine atom, etc.); a lower alkyl group, preferably having from 1 to 4 carbon atoms, such as a methyl group, an ethyl group, a propyl group, a butyl group, etc.; a lower alkoxy group, preferably having 1 to 4 carbon atoms, such as a methoxy group, an ethoxy group, etc.; or an unsubstituted or substituted phenyl group (e.g., a phenyl group, etc.).

Specific examples of sensitizing dyes which are used according to this invention are shown below, but the sensitizing dyes in this invention are not limited thereto.

(I-1)

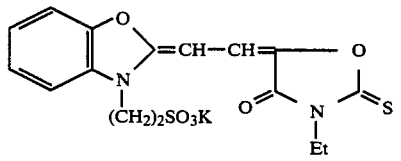

(Et is an ethyl group, hereinafter the same)

(I-2)

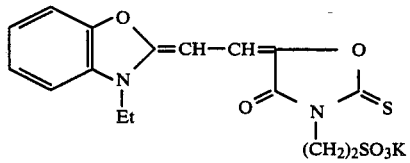

(I-3)

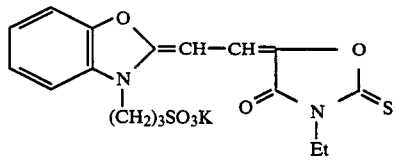

(I-4)

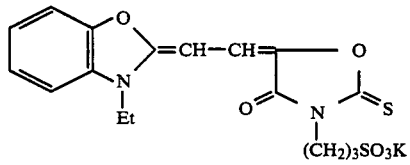

(I-5)

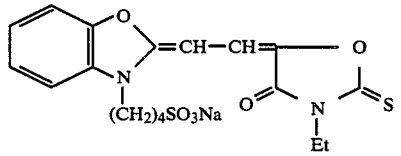

(I-6)

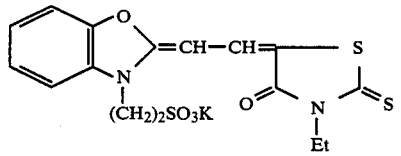

(I-7)

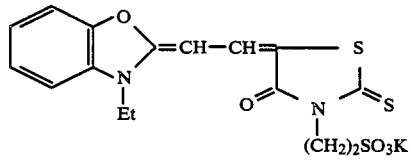

(I-8)

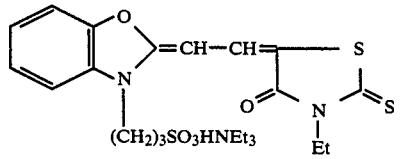

-continued
(I-9)
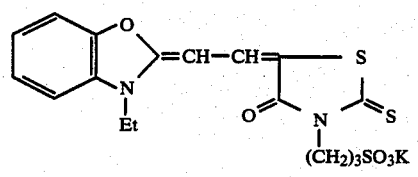
(I-10)
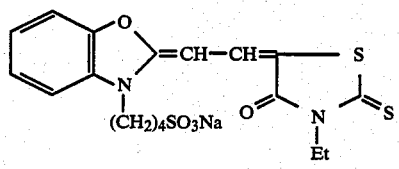
(I-11)
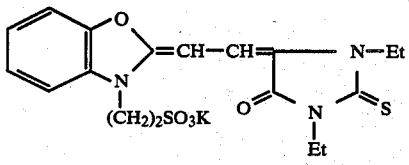
(I-12)
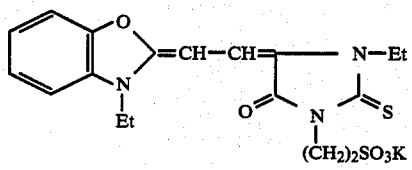
(I-13)
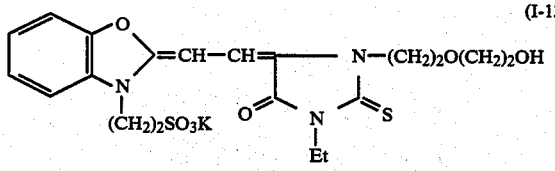
(I-14)
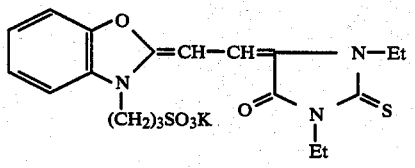
(I-15)
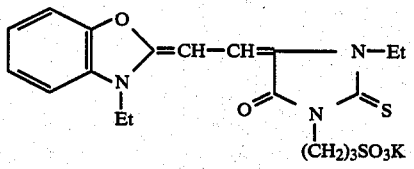
(I-16)
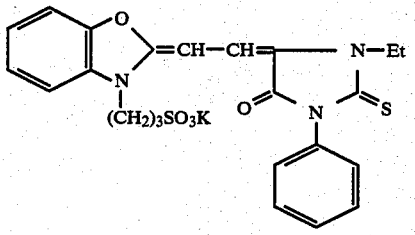
-continued
(I-17)
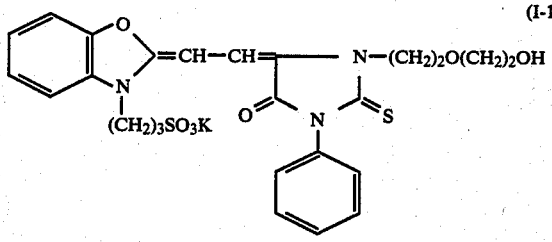
(I-18)
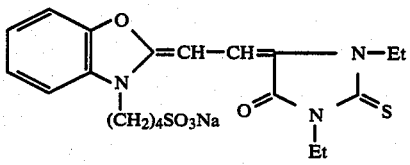
(I-19)
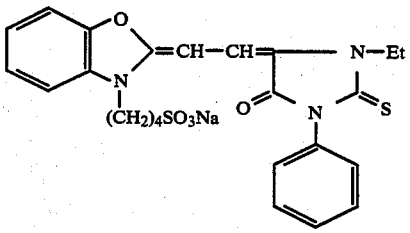
(I-20)
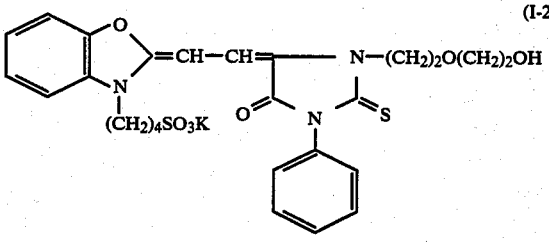
(I-21)
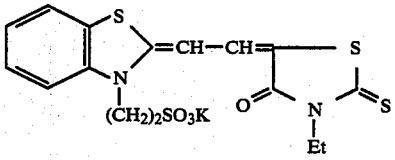
(I-22)
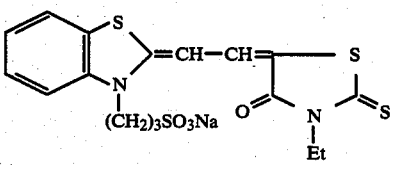
(I-23)
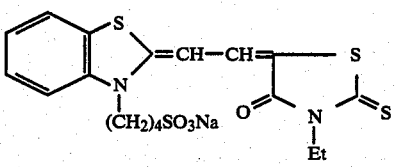
(I-24)
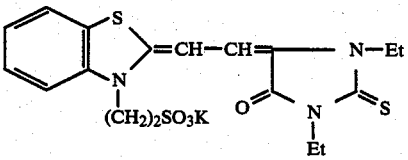

-continued (I-25)

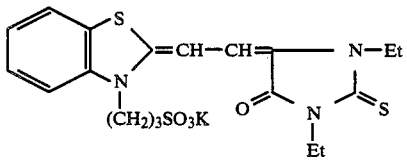

(I-26)

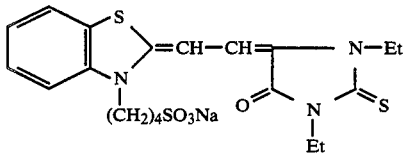

(I-27)

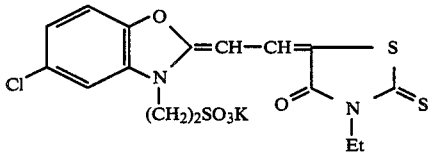

(I-28)

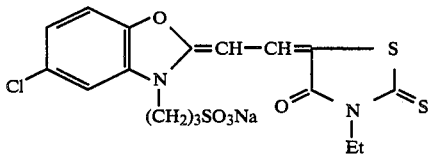

(I-29)

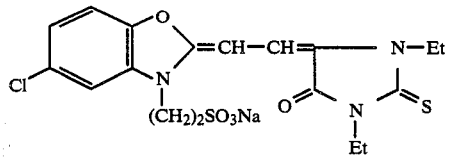

(I-30)

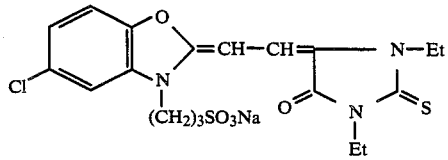

(I-31)

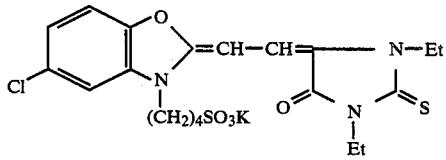

(I-32)

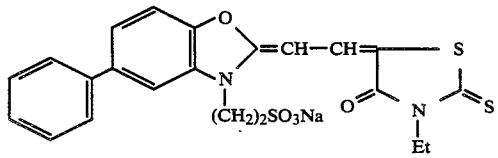

(I-33)

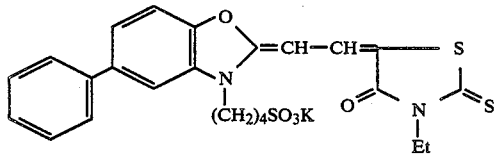

-continued (I-34)

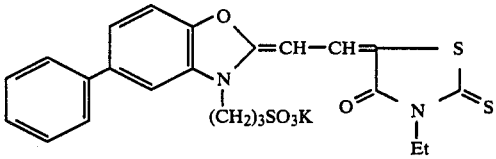

(I-35)

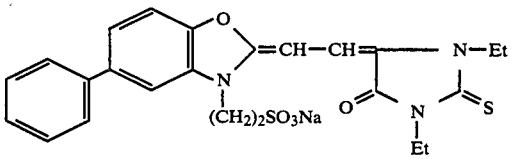

(I-36)

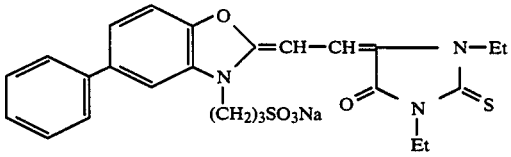

(I-37)

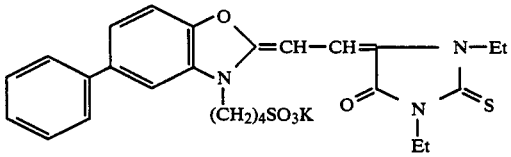

When internal latent image-type direct positive silver halide photographic emulsions are spectral-sensitized using these sensitizing dyes, the internal latent image-type direct positive silver halide emulsions showing very excellent stability with the passage of time even in the case of applying a high temperature development can be prepared.

The sensitizing dyes represented by formula (I) are known compounds, and can be prepared, e.g., according to conventional methods as described in F. M. Hamer, *Cyanine Dyes and Related Compounds,* (Interscience Publishers, 1964).

A sensitizing dye represented by formula (I) used according to this invention is effectively used in a concentration of from about $1\times10^{-5}$ to $2\times10^{-3}$ mol per mol of silver halide. The optimum concentration of the sensitizing dye can be determined by splitting the silver halide emulsion into several parts, incorporating the sensitizing dye in each part of the emulsion at a different concentration, and measuring the spectral sensitivity of the emulsion in a conventional manner.

The addition of the sensitizing dye to the silver halide emulsion may be performed in a conventional manner. For example, the sensitizing dye may be directly dispersed in the silver halide emulsion or may be added to the silver halide emulsion as a solution thereof in a water-miscible solvent such as pyridine, methanol, ethanol, methyl cellosolve, acetone, etc., or a mixture thereof, which may be diluted with water, or as an aqueous solution thereof. Ultrasonic vibration may be applied for accelerating the dissolution of the sensitizing dye. Still further, the methods described in Japanese Patent Publication Nos. 8231/70, 23389/69 and 27555/69, West German Patent Application (OLS) No. 1,947,935, U.S. Pat. Nos. 2,912,343, 3,342,605, 3,485,634, etc., may be employed for dissolving the sensitizing dye.

When two or more sensitizing dyes are employed according to this invention, they may be added to the silver halide emulsion as solutions in different solvents, or may be added thereto as a mixture of solutions thereof in the same or different solvents.

Examples of the internal latent image-type silver halide emulsions used in this invention include, for example, a conversion-type silver halide emulsion prepared by a catastrophic precipitation method wherein silver salt grains having relatively high solubility, such as silver chloride are first prepared and then converted into a silver salt having a relatively low solubility, such as silver (iodo)bromide (U.S. Pat. No. 2,592,250); a core-shell silver halide emulsion prepared by mixing a core silver halide emulsion which was chemically sensitized and has large grain size with a fine grain silver halide emulsion followed by ripening, whereby the core silver halide grains are coated with a shell of silver halide (U.S. Pat. No. 3,206,313 and British Pat. No. 1,011,062); a core-shell silver halide emulsion prepared by simultaneously adding an aqueous solution of a soluble silver salt and an aqueous solution of a soluble halide to a chemically sensitized monodispersed core silver halide emulsion while maintaining a constant silver ion concentration to cover the silver halide grains with a shell of silver halide (British Pat. No. 1,027,146 and U.S. Pat. No. 3,761,276); a halogen localized silver halide emulsion composed of emulsion grains in a two or more laminated layer structure, wherein the halogen composition of the first phase differs from that of the second phase (U.S. Pat. No. 3,935,014); and a silver halide emulsion containing a foreign metal prepared by forming the silver halide grains in an acid medium containing a trivalent metal ion (U.S. Pat. No. 3,447,927). Other internal latent image-type silver halide emulsions can be prepared by methods as described in E. J. Wall, *Photographic Emulsions,* pages 35–36 and pages 52–53, published by American Photographic Publishing Co. (1929); U.S. Pat. Nos. 2,497,875, 2,563,785 and 3,511,662, West German Patent Application (OLS) No. 2,728,108, etc.

Among the above-described various internal latent image-type silver halide emulsions, the core-shell silver halide emulsions are preferably used for obtaining good reversal photographic properties.

The internal latent image-type silver halide grains constituting the silver halide emulsion of this invention are prepared by doping silver halide grains with a metal ion, or chemically sensitizing silver halide grains, or applying both the treatments to silver halide grains to form internal nuclei of silver halide grains, then covering the surface thereof with outer shells of silver halide, and, if desired, further chemically sensitizing the outer shells of the silver halide. The grain surfaces of the internal nuclei may be only partially covered by the outer shell, but it must be sufficient to cover at least the photosensitive site (the portion of forming light-decomposed silver by light exposure) of the internal nuclei.

The metal ion doping for the internal nuclei can be performed, for example, by forming the silver halide grains for the internal nuclei or physically ripening the silver halide grains in the presence of a metal ion source such as a cadmium salt, a zinc salt, a lead salt, a thallium salt, an iridium salt or a complex salt thereof, a rhodium salt or a complex salt thereof, an iron salt or a complex salt thereof, etc. The proportion of the metal ion is usually $10^{-7}$ mol or more per mol of silver halide.

The silver halide for the internal nuclei may be chemically sensitized using a noble metal sensitizer, a sulfur sensitizer, a reducing agent, or a combination thereof in place of the above-described metal ion doping. The application of a gold sensitization and a sulfur sensitization particularly increases the sensitivity.

Such a treatment of the silver halide for the internal nuclei and a method of covering the grain surface of the silver halide for the internal nuclei with a silver halide constituting the outer shell are known, as described, for example, in U.S. Pat. Nos. 3,206,316, 3,317,322, 3,367,778 (excluding the step of fogging the grain surfaces); and 3,761,276.

The ratio of the silver halide of the internal nuclei and the silver halide of the outer shell may be varied, but usually the proportion of the silver halide of the outer shell is from 2 to 8 mols per mol of the silver halide of the internal nuclei.

It is preferred that the composition of the silver halide for the internal nuclei be the same as that of the silver halide for the outer nuclei, but they may have different compositions.

As the silver halides which are used in this invention, there are silver bromide, silver iodide, silver chloride, silver chlorobromide, silver bromoiodide, silver chlorobromoiodide, etc. A preferred silver halide emulsion contains at least 50 mol% silver bromide and the most preferred emulsion is a silver bromoiodide emulsion containing less than 10 mol% silver iodide.

In this invention, internal latent image-type silver halide grains having various grain sizes can be used, but the internal latent image-type silver halide grains having a mean grain diameter of from about 0.1 to about 4 microns, and more preferably from about 0.2 to about 2 microns, give better results.

When the internal latent image-type silver halide grains which are used in this invention are of a monodispersion type, preferred results are obtained, but the silver halide grains are not limited to the monodispersion type. The expression "monodispersed silver halide emulsion" as used herein means a silver halide emulsion composed of silver halide grains having substantially uniform grain size. Preferably, about 95% of the silver halide grains are within 40% of the mean grain size, and more preferably within 30% of the mean grain size.

The internal latent image-type silver halide grains used in this invention may be of a regular crystal form such as a cubic system, octahedral, an irregular crystal form such as a globular crystal, tabular crystal, etc., a composite form of these crystal forms, or further a mixture of grains having these various crystal forms.

The grain surface of the internal latent image-type silver halide described above may be chemically sensitized, if desired.

The grain surface of the internal latent image-type silver halide can be chemically sensitized by methods as described in Glafkides, *Chimie et Physique Photographique,* published by Paul Montel (1967), V. L. Zelikman et al., *Making and Coating Photographic Emulsion,* published by the Focal Press (1964), and H. Frieser, *Die Grundlagen der Photographischen Prozesse mit Silberhalogeniden,* published by Akademische Verlagsgesellschaft (1968).

More particularly, for the chemical sensitization, a sulfur sensitizing method using a compound containing sulfur capable of reacting with silver ion or active gelatin; a reduction sensitizing method using a reducing material; a noble metal sensitizing method using a noble metal compound such as a gold compound, etc., can be used, singly or as combinations thereof. Among them, a combination of a gold sensitizing method and a sulfur sensitizing method gives best results, but a reduction sensitizing method may be also used therewith.

Examples of the sulfur sensitizer include thiosulfates, thioureas, thiazoles, rhodanines, etc., and practical examples are described in U.S. Pat. Nos. 1,574,944, 2,410,689, 2,278,947, 2,728,668, 3,656,955, etc.

Examples of the reduction sensitizer include stannous salts, amines, hydrazine derivatives, formamidine-sulfinic acid silane compounds, etc., and practical examples thereof are described in U.S. Pat. Nos. 2,487,850, 2,419,974, 2,518,698, 2,983,609, 2,983,610, 2,694,637, etc.

Examples of the noble metal sensitizer include gold complex salts as well as complex salts of noble metals belonging to Group VIII of the Periodic Table, such as platinum, iridium, palladium, etc., and practical examples thereof are described in U.S. Pat. Nos. 2,399,083 and 2,448,060, British Pat. No. 618,061, etc.

Conditions for the chemical sensitizing conditions can be varied, but, in general, the conditions of a pH lower than 9, a pAg lower than 10, and a temperature higher than 40° C. give preferred results, although other conditions may be also employed according to this invention. The chemical sensitization of the surface of the internal latent image-type silver halide grains is, as a matter of course, performed to an extent of not reducing the characteristics of the internal latent image-type silver halide grains as the internal latent image type. The expression "the characteristics as the internal latent image type" means the property such that when the silver halide emulsion is coated on a transparent support and the light-sensitive sample is exposed for a definite time between 0.01 and 10 sec. and developed in developer A (internal latent image-type developer) for 3 minutes at 20° C., the maximum density of the image thus formed measured by a conventional photographic measuring method is at least five times larger than the maximum density obtained in the case of developing the exposed sample having the same silver halide emulsion layer in developer B (surface type developer) for 4 minutes at 20° C.:

| | |
|---|---|
| Developer A: | |
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 liter |
| Developer B: | |
| p-Oxyphenylglycine | 10 g |
| Sodium Carbonate | 100 g |
| Water to make | 1 liter |

The internal latent image-type silver halide grains according to this invention are dispersed in a binder.

As the binder, gelatin is advantageously used, but hydrophilic colloids other than gelatin can also be used.

Examples of suitable hydrophilic colloids are proteins such as gelatin derivatives, graft polymers of gelatin and other polymers, albumin and casein, cellulose derivatives such as hydroxyethyl cellulose, carboxymethyl cellulose and cellulose sulfuric acid esters, and sugar derivatives such as sodium alginate and starch derivatives.

Lime-processed gelatin, acid-processed gelatin and enzyme-processed gelatin as described in *Bull. Soc. Sci. Photo.*, Japan, No. 16, page 30 (1966) can be used as the gelatin. In addition, hydrolyzates and enzyme decomposition products of gelatin can be used. As gelatin derivatives, it is possible to use those obtained by reacting gelatin with various compounds, for example, acid halides, isocyanates, bromoacetic acid, alkane-sultones, vinylsulfonamides, maleimide compounds, polyalkylene oxides and epoxy compounds, etc. Examples thereof have been described in U.S. Pat. Nos. 2,614,928, 3,132,945, 3,186,846 and 3,312,533, British Pat. Nos. 861,414, 1,033,189 and 1,005,784, and Japanese Patent Publication No. 26845/67, etc.

As the above-described graft polymers of gelatin, it is possible to use those prepared by grafting homo- or copolymers of vinyl monomers such as acrylic acid, methacrylic acid or derivatives thereof such as esters or amide, etc., acrylonitrile or styrene, etc., on gelatin. Particularly, it is preferred to use graft polymers prepared by grafting polymers having a certain degree of compatibility with gelatin, such as polymers of acrylic acid, methacrylic acid, acrylamide, methacrylamide or hydroxyalkyl methacrylate, etc., on gelatin. Examples thereof have been described in U.S. Pat. Nos. 2,763,625, 2,831,767, 2,956,884, etc.

The internal latent image-type silver halide emulsions obtained as described above are spectral-sensitized by the sensitizing dyes described hereinbefore and then coated on a support, if desired, together with other photographic layer or layers. In this case, the silver halide emulsions used may have a same mean grain size or may be a mixture of two or more kinds of silver halide emulsions having different sensitivity and grain sizes. Furthermore, these silver halide emulsions may be coated in double or multiple layers.

For preparing a photographic material using the internal latent image-type silver halide photographic emulsion or emulsions of this invention, the silver halide emulsion or emulsions of this invention are coated on a support with, if desired, other photographic layer or layers. There is no particular restriction on the coating amount of the silver halide emulsion of this invention, but a preferred reversal image is obtained when the silver halide emulsion of this invention is coated at a silver coverage of about 40 mg to about 800 mg per square feet of support.

Details regarding supports which can be used in the practice of this invention are described, e.g., in *Research Disclosure,* Vol. 176 (December, 1978), RD-17643, Paragraph XVII.

The internal latent image-type silver halide photographic emulsions of this invention may contain polyalkylene oxides or the ethers, esters, amines, etc., thereof, thioether compounds, thiomorpholines, quaternary ammonium compounds, urethane derivatives, urea derivatives, imidazole derivatives, 3-pyrazolidone derivatives, etc., for the purposes of increasing sensitivity, increasing contrast, and accelerating development. Practical examples of these additives are described, for example, in U.S. Pat. Nos. 2,400,532, 2,423,549, 2,716,062, 3,617,280, 3,772,021, 3,808,003, etc.

The internal latent image-type silver halide photographic emulsion of this invention may further contain an antifoggant and a stabilizer. Such additives are described in *Research Disclosure,* Vol. 176 (December, 1978), RD-17643, Paragraph VI.

Also, the internal latent image-type silver halide photographic emulsion of this invention may contain a developing agent, examples of which are described in *Research Disclosure,* Vol. 176 (December, 1978), RD-17643, Paragraph (XX).

The internal latent image-type silver halide photographic emulsions of this invention can be hardened by an organic or inorganic hardening agent. Examples of the hardening agent are described in *Research Disclosure,* Vol. 176 (December, 1978), RD-17643, Paragraph (X).

Furthermore, the internal latent image-type silver halide photographic emulsion of this invention may contain a coating aid, examples of which are described in *Research Disclosure,* Vol. 176 (December, 1978), RD-17643, Paragraph (XI).

The internal latent image-type silver halide photographic emulsion of this invention may further contain a color coupler. Examples of the color coupler are described in *Research Disclosure,* Vol. 176 (December, 1978), RD-17643, Paragraph (VII).

Moreover, the internal latent image-type silver halide photographic emulsions of this invention may contain antistatic agents, plasticizers, matting agents, lubricants, ultraviolet absorbents, fluorescent brightening agents, aerial fog preventing agents, etc.

The photographic materials prepared using the internal latent image-type silver halide photographic emulsions of this invention may contain dyes as filter dyes or anti-irradiation dyes in the photographic silver halide emulsion layers or other hydrophilic colloid layers. Such dyes are described in *Research Disclosure,* Vol. 176 (December 1978), RD-17643, Paragraph (VIII).

The internal latent image-type silver halide photographic emulsion of this invention forms reversal images by development in the presence of a fogging agent (nucleating agent), or the development under overall light exposure. Examples of fogging agents that can be used according to this invention include hydrazines as described in U.S. Pat. Nos. 2,563,785, 2,588,982, etc.; hydrazides and hydrazones as described in U.S. Pat. No. 3,227,552, etc.; quaternary salt compounds described in British Pat. No. 1,283,835, Japanese Patent Publication No. 38164/74, U.S. Pat. Nos. 3,615,615, 3,719,494, 3,734,738, 4,094,683, 4,115,122, etc.; sensitizing dyes having a nucleating group having a fogging action in the dye molecule as described in U.S. Pat. No. 3,718,470, etc.; acylhydrazinophenylthiourea compounds as described in U.S. Pat. Nos. 4,030,925, 4,031,127, etc.; and acylhydrazinophenylurea compounds as described in Japanese Patent Application (OPI) No. 86829/82 (the term "OPI" as used herein refers to a "published unexamined Japanese patent application"). Examples of other compounds which are used in this invention for these purposes are described in U.S. Pat. No. 4,139,387, Japanese Patent Application (OPI) Nos. 133126/79 and 74729/79.

Among the fogging agents described above, the fogging agent represented by formula (II) described in Japanese Patent Application (OPI) No. 86829/82 gives particularly excellent results; i.e.,

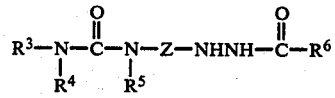

(II)

wherein $R^3$ and $R^4$, which may be the same or different, each represents a hydrogen atom, an aliphatic residue, an aromatic residue or a heterocyclic residue; $R^5$ *represents a hydrogen atom or an aliphatic residue;* $R^6$ represents a hydrogen atom, an aliphatic residue, or an aromatic residue; and Z represents a divalent aromatic residue.

In more detail, the aliphatic residues shown by $R^3$, $R^4$ and $R^5$ include a straight chain or branched alkyl group, a cycloalkyl group, the above groups having a substituent, an alkenyl group, and an alkynyl group.

The straight chain and branched alkyl groups shown by $R^3$ and $R^4$ include alkyl groups having from 1 to 18 carbon atoms, and preferably from 1 to 8 carbon atoms. Specific examples thereof are a methyl group, an ethyl group, an isobutyl group, a t-octyl group, etc. The straight chain and branched alkyl groups shown by $R^6$ include alkyl groups having from 1 to 10 carbon atoms, and specific examples thereof are a methyl group, an ethyl group, a propyl group, etc.

The cycloalkyl groups shown by $R^3$, $R^4$ and $R^5$ preferably have from 3 to 10 carbon atoms, and specific examples thereof are a cyclopropyl group, a cyclohexyl group, an adamantyl group, etc.

The above-described alkyl group and cycloalkyl group may have a substituent and examples of the substituent are an alkoxy group (e.g., a methoxy group, an ethoxy group, a propoxy group, a butoxy group, etc.), an alkoxy-carbonyl group, a carbamoyl group, a hydroxy group, an alkylthio group, an amido group, an acyloxy group, a cyano group, a sulfonyl group, a halogen atom (e.g., chlorine, bromine, fluorine, iodine, etc.), an aryl group (e.g., a phenyl group, a halogen-substituted phenyl group, an alkyl-substituted phenyl group, etc.), etc. Specific examples of the substituted alkyl and cycloalkyl groups are a 3-methoxypropyl group, an ethoxycarbonylmethyl group, a 4-chlorocyclohexyl group, a benzyl group, a p-methylbenzyl group, a p-chlorobenzyl group, etc.

Examples of the alkenyl group shown by $R^3$, $R^4$ and $R^5$ are an allyl group, etc., and examples of the alkynyl group are a propargyl group, etc.

On the other hand, the aromatic residues shown by $R^3$, $R^4$ and $R^6$ include a phenyl group, a naphthyl group and the above groups having a substituent (e.g., an alkyl group, an alkoxy group, an acylhydrazino group, a dialkylamino group, an alkoxycarbonyl group, a cyano group, a carboxy group, a nitro group, an alkylthio group, a hydroxy group, a sulfonyl group, a carbamoyl group, a halogen atom, an acylamino group, a sulfonamido group, a thiourea group, etc.). Specific examples of the substituted aryl groups are a p-methoxyphenyl group, an o-methoxyphenyl group, a tolyl group, a p-formylhydrazinophenyl group, a p-chlorophenyl group, an m-fluorophenyl group, an m-benzamido group, an m-acetamidophenyl group, an m-benzenesulfonamido group, an m-phenylthiourea group, etc.

The heterocyclic residues shown by $R^3$ and $R^4$ include a 5-membered or 6-membered ring and condensed ring having at least one of oxygen, nitrogen, sulfur and selenium therein, and said ring and condensed ring may have a substituent. Specific examples thereof are a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring, a naphthoselenazole ring, etc.

These heterocyclic rings may have a substituent such as an alkyl group having from 1 to 4 carbon atoms such as a methyl group, an ethyl group, etc.; an alkoxy group having from 1 to 4 carbom atoms such as a methoxy group, an ethoxy group, etc.; an aryl group having from 6 to 18 carbon atoms such as a phenyl group, etc.; a halogen atom such as a chlorine atom, a bromine atom, etc.; an alkoxycarbonyl group; a cyano group; an amido group, etc.

It is preferred that one of $R^3$ and $R^4$ be a hydrogen atom. Furthermore, it is preferred that $R^6$ be a hydrogen atom or a methyl group, and more preferably a hydrogen atom.

The aliphatic residue shown by $R^5$ includes a straight chain or branched alkyl group, a cycloalkyl group, these groups each having a substituent, an alkenyl group, and an alkynyl group. The straight chain or branched alkyl group shown by $R^5$ is, for example, an alkyl group having 1 to 18 carbon atoms, preferably from 1 to 6 carbon atoms, and specific examples are a methyl group, an ethyl group, an isopropyl group, etc. The cycloalkyl group shown by $R^5$ is, for example, a cycloalkyl group having from 3 to 10 carbom atoms, and specific examples are a cyclopentyl group, a cyclohexyl group, etc. Examples of the substituents for these groups are an alkoxy group (e.g., a methoxy group, an ethoxy group, etc.), an alkoxycarbonyl group, an aryl group (e.g., a phenyl group, a halogen-substituted phenyl group, an alkoxyphenyl group, an alkylphenyl group, etc.), an amido group, an acyloxy group, etc. Also, specific examples of the substituted alkyl groups are a 3-methoxypropyl group, a benzyl group, a p-chlorobenzyl group, a p-methoxybenzyl group, a methylbenzyl group, etc. The alkenyl group shown by $R^5$ is, for example, an alkenyl group having 3 to 12 carbon atoms, such as an allyl group, a 2-butenyl group, etc.

$R^5$ is preferably a hydrogen atom.

Z represents a divalent aromatic residue and specific example thereof are a phenylene group, a naphthylene group (a 1,2-naphthylene group, a 1,4-naphthylene group, a 2,3-naphthylene group, a 1,5-naphthylene group, a 1,8-naphthylene group, etc.), and the aforesaid groups having a substituent.

Examples of the substituent of the divalent aromatic residue are an alkyl group having from 1 to 20 carbon atoms, which may have a branch; an aralkyl group the alkyl moiety of which has 1 to 3 carbon atoms; an alkoxy group, preferably having from 1 to 20 carbon atoms; a substituted alkoxy group, preferably having from 1 to 20 carbon atoms; an amino group mono- or di-substituted by an alkyl group or a substituted alkyl group, preferably having from 1 to 20 carbon atoms; an aliphatic acylamino group, preferably having from 2 to 21 carbon atoms; an aromatic acylamino group; an alkylthio group; a hydroxy group; a halogen atom (e.g., chlorine, etc.); etc.

A more preferred example of the divalent aromatic residue Z is a phenylene group.

Particularly preferred compounds among the compounds shown by general formula (II) are compounds represented by formula (III):

$$R^3-NHC(=O)NH-Z-NHNHCHO \quad \text{(III)}$$

wherein $R^3$ and Z have the same meanings as defined for formula (II).

Specific examples of the fogging agent useful in this invention are illustrated below.

II-1: 1-Formyl-2-[4-(3-phenylureido)phenyl]hydrazine
II-2: 2-{4-[3-(4-Chlorophenyl)ureido]phenyl}-1-formylhydrazine
II-3: 2-{4-[3-(2-Chlorophenyl)ureido]phenyl}-1-formylhydrazine
II-4: 1-Formyl-2-{4-[3-(4-methoxyphenyl)ureido]phenyl}hydrazine
II-5: 1-Formyl-2-{2-methoxy-4-[3-(4-methylphenyl)ureido]phenyl}hydrazine
II-6: 1-Formyl-2-{4-[3-(2-methoxyphenyl)ureido]phenyl}hydrazine
II-7: 2-{4-[3-(3-Acetamidophenyl)ureido]phenyl}-1-formylhydrazine
II-8: 1-Formyl-2-[3-(3-phenylureido)phenyl]hydrazine
II-9: 1-Formyl-2-{4-[3-(2-pyridyl)ureido]phenyl}hydrazine
II-10: 2-[4-{3-[3-(2,4-Di-t-amylpheoxyacetamido)phenyl]ureido}phenyl]-1-formylhydrazine
II-11: 2-{4-[3-(2-Benzthiazolyl)ureido]phenyl}-1-formylhydrazine
II-12: 1-Formyl-2-{4-[3-(4-methylthiazol-2-yl)ureido]phenyl}hydrazine
II-13: 2-{4-[3-(3-Benzamidophenyl)ureido]phenyl}-1-formylhydrazine
II-14: 2-{4-[3-(3-Benzenesulfonamidophenyl)ureido]phenyl}-1-formylhydrazine
II-15: 1-Acetyl-2-[4-(3-phenylureido)phenyl]hydrazine
II-16: 1-Benzoyl-2-[4-(3-phenylureido)phenyl]hydrazine
II-17: 1-(4-Chlorobenzoyl)-2-[2-methyl-4-(3-phenylureido)phenyl]hydrazine
II-18: 1-Cyclohexylcarbonyl-2-[4-(3-phenylureido)phenyl]hydrazine The compounds shown by formula (II) which are used in this invention can be generally prepared by the following method.

2-(4- or 3-nitrophenyl)-1-formylhydrazine is obtained by the reaction of 4- or 3-nitrophenylhydrazine and formic acid or a corresponding acid anhydride or acid chloride. These nitrophenylhydrazines are easily converted into the corresponding amino compounds by catalytically reducing them using an alcohol (e.g., ethanol, methyl cellosolve, etc.) or dioxane as a solvent and palladium-carbon as a catalyst, or by heating them together with reduced iron in an alcohol. The amino compound thus obtained is reacted with an isocyanate or a precursor thereof in a nonprotonic polar solvent (such as dimethylformamide, acetonitrile, tetrahydrofuran, dioxane, etc.) to obtain the desired compound of the formula (II).

Starting materials for the compounds shown by formula (II) and practical synthesis methods of these compounds are described in Japanese Patent Application (OPI) No. 86829/82.

It is preferred that in the direct positive photographic material of this invention, the compound represented by formula (II) is incorporated in the internal latent image-type silver halide emulsion layer, but the compound may be present in a hydrophilic colloid layer adjacent to the internal latent image-type silver halide emulsion layer. The layer containing the fogging agent represented by formula (II) may be a layer having any function, such as a photosensitive layer, an interlayer, a filter layer, a protective layer, an antihalation layer, etc., with the proviso that the layer does not prevent the fogging agent from diffusing to the internal latent image-type silver halide.

In the photographic material using the internal latent image-type silver halide emulsion of this invention, it is preferred that the content of the fogging agent of formula (II) be present in a photographic layer of the photographic material, in an amount capable of providing a sufficient maximum density (e.g., higher than 1.70) when the internal latent image-type emulsion is developed by a surface developer. In reality, the amount of the fogging agent depends upon the characteristics of the silver halide emulsions, the chemical structure of the fogging agent, and the development conditions and hence can be selected in a wide range. A useful amount of the fogging agent is generally from about 0.1 mg to about 5,000 mg, and more preferably from about 0.5 mg to about 2,000 mg, per mol of silver in the internal latent image-type silver halide emulsion. When the fogging agent is incorporated in a hydrophilic layer adjacent to a silver halide emulsion layer, the amount of the fogging agent may be the same as above per the amount of silver in the internal latent image-type emulsion layer.

It is preferred that the fogging agent be present in a silver halide photographic emulsion layer or a layer adjacent to the photographic emulsion layer.

The internal latent image-type silver halide photographic emulsions of this invention can be used for various purposes, but are advantageously used as silver halide emulsions for direct positive photographic materials, silver halide emulsions for multilayer reversal color photographic materials, or silver halide emulsions for multilayer structure color diffusion transfer process.

The photographic material using the internal latent image-type silver halide emulsion of this invention can be processed by known processes. Known development processes and known fix processes may be employed, and if desired, a stop process and water washing process may be employed. The processing temperature is selected usually from 18° C. to 50° C., but a temperature lower than 18° C. or higher than 50° C. may be employed.

The photographic materials used in this invention can be developed using various known developing agents. Examples of the developing agent are polyhydroxybenzenes such as hydroquinone, 2-chlorohydroquinone, 2-methylhydroquinone, catechol, pyrogallol, etc.; aminophenols such as p-aminophenol, N-methyl-p-aminophenol, 2,4-diaminophenol, etc.; 3-pyrazolidones such as 1-phenyl-3-pyrazolidone, 1-phenyl-4,4'-dimethyl-3-pyrazolidone, 1-phenyl-4-methyl-4-hydroxymethyl-3-pyrazolidone, 5,5-dimethyl-1-phenyl-3-pyrazolidone, etc.; ascorbic acids, etc. They can be used singly or as a combination thereof. Furthermore, the developers described in Japanese Patent Application (OPI) No. 55928/83 can be effectively used.

For obtaining dye images in the presence of dye-forming couplers using the internal latent image-type silver halide emulsions of this invention, an aromatic primary amine developing agent, preferably a 1-phenylenediamine series developing agent, can be used. Specific examples of the developing agent are 4-amino-3-methyl-N,N-diethylaniline hydroquinone, N,N-diethyl-p-phenylenediamine, 3-methyl-4-amino-N-ethyl-N-β-(methanesulfoamido)ethylaniline, 3-methyl-4-amino-N-ethyl-N-(β-sulfoethyl)aniline, 3-ethoxy-4-amino-N-ethyl-N-(β-sulfoethyl)aniline, 4-amino-N-ethyl-N-(β-hydroxyethyl)aniline, etc. Such a developing agent may be present in an alkaline processing composition (processing element) or may be present in a proper layer of a photosensitive element.

The developer which is used for developing the photographic material in this invention may further contain a preservative such as sodium sulfite, potassium sulfite, ascorbic acid, a reductone (e.g., piperidinohexose reductone), etc.

By developing the photographic material of this invention using a surface developer, a direct positive image can be obtained. The developing course by the surface developer is induced by the latent images or fogging nuclei existing on the surface of silver halide grains. It is preferred that the developer does not contain a silver halide solvent, but the developer may contain a silver halide solvent (e.g., a sulfite) if the internal latent image does not substantially take part in the development until the development of the silver halide grains by the surface developing centers is finished.

The surface developer may contain sodium hydroxide, potassium hydroxide, sodium carbonate, potassium carbonate, sodium tertiary phosphate, sodium metaborate, etc., as an alkaline agent or a buffer. The content of the agent is selected such that the pH of the developer is from 10 to 13, and preferably is from 11 to 12.5.

The developer may further contain a color development accelerating agent such as benzyl alcohol. Still further, the developer advantageously contains a compound that is usually used as an antifoggant, such as benzimidazoles (e.g., 5-nitrobenzimidazole, etc.) and benzotriazoles (e.g., benzotriazole, 5-methylbenzotriazole, etc.) for more lowering the minimum density of the direct positive images.

The developer may further contain, if desired, a dissolution assistant, a color toning agent, a development accelerator, a surface active agent, a defoaming agent, a water softener, a hardening agent, a tackifier, etc.

A fixing solution having a conventional fixing composition can be used in this invention. That is, a fixing solution containing a thiosulfate, a thiocyanate, as well as an organic sulfur compound having an effect as a fixing agent can be used.

The fixing solution may further contain a water-soluble aluminum salt as a hardening agent.

As the stop solution, an aqueous solution having a low pH may be generally used. Practically, an aqueous solution containing acetic acid, sulfuric acid, etc., having a pH lower than 3.5 may be used. It is preferred that the stop solution contains a buffer.

Advantageous features of the internal latent image-type direct positive silver halide photographic emulsion of this invention include obtaining direct positive images having good stability with respect to the passage of time during storage prior to development and good reversal photographic properties, based on using the sensitizing dye of this invention according to formula (I) in the case of performing the surface development in the presence of a fogging agent. Also, in this case, the use of the fogging agent according to formula (II) gives particularly preferred results.

Also, the internal latent image-type silver halide emulsion of this invention is effectively used in the case of a developing at temperatures higher than 35° C., and further is more effectively used when the photographic material having the photographic layer or layers of the internal latent image-type silver halide emulsions of this invention are exposed to an atmosphere containing oxygen and moisture as ordinary state.

The following examples will still further illustrate the present invention, but are not intended to limit it in any way.

EXAMPLE 1

An internal latent image-type silver halide emulsion (Emulsion I) having a mean grain size of 0.4 micron was prepared by converting a silver chloride emulsion with excessive potassium bromide according to the method described in U.S. Pat. No. 2,592,250.

Emulsion I was split into six parts each of about the same amount, and after adding to the respective emulsions each of Sensitizing Dyes (I-8), (I-14), (I-22) and (I-34) and Comparison Sensitizing Dyes (A) and (B) shown below, in an amount of $5\times10^{-4}$ mol per mol of the silver halide in the silver halide emulsion, and further 150 mg of Fogging Agent (II-4), 1-formyl-2-{4-[3-(4-methoxyphenyl)ureido]phenyl}hydrazine per mol of the silver halide, each of the mixtures was coated on a polyethylene terephthalate support at a silver coverage of 3,000 mg/m$^2$, and then a gelatin protective layer was formed thereon to provide Samples 1-1 to 1-6, respectively.

Sensitizing Dye (A):

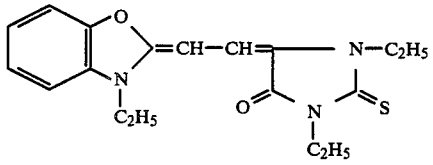

Sensitizing Dye (B):

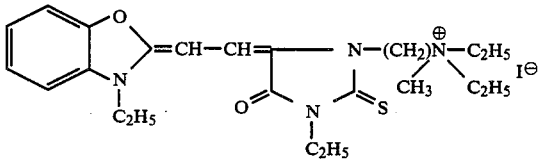

Each of these samples was allowed to stand at 50° C. and at a relative humidity of 10% for 4 days, exposed to a tungsten lamp of 1 kw through a step wedge for 1 sec. at a color temperature of 2,854° K., and developed using Developer C having the composition shown in Table 1 below for 1 minute at 35° C. Then, each sample was stopped, fixed, and water washed according to conventional methods.

On the other hand, Samples 1-1 to 1-6 prepared in the same manner as above were stored at room temperature (about 25° C.) and a relative humidity of 90% for 3 days, exposed under the same condition as above, and then developed by the developer having the same composition as above under the same condition as above described.

The changes in reversal sensitivity of each sample with the passage of time are shown in Table 2 below.

As the sensitivity point, the $-\log E$ value that the optical density became $(D_{min}+D_{max})/2$ was employed and the change of sensitivity was shown by the value obtained by subtracting the sensitivity before the passage of time from the sensitivity after the passage of time.

TABLE 1

| Developer C: | |
|---|---|
| Sodium Sulfite | 50 g |
| Potassium Carbonate | 40 g |
| Sodium Bromide | 5 g |
| Pyrazolone | 2 g |
| Hydroquinone | 22 g |
| 5-Methylbenzotriazole | 20 mg |
| Water to make | 1 liter |
| pH adjusted to 11.8 with potassium hydroxide | |

TABLE 2

| Sample No. | Emulsion | Sensitizing Dye | Sensitivity Change (a)* | Sensitivity Change (b)** |
|---|---|---|---|---|
| 1-1 | I | Sensitizing Dye (I-8) | −0.05 | −0.04 |
| 1-2 | I | Sensitizing Dye (I-14) | −0.07 | −0.03 |
| 1-3 | I | Sensitizing Dye (I-22) | −0.04 | −0.04 |
| 1-4 | I | Sensitizing Dye (I-34) | −0.08 | −0.07 |
| 1-5*** | I | Sensitizing Dye (A) | −0.19 | +0.15 |
| 1-6*** | I | Sensitizing Dye (B) | −0.25 | +0.21 |

(a)*After storing for 4 days at 50° C. and 10% RH.
(b)**After storing for 3 days at 25° C. and 90% RH.
***Samples 5 and 6: Comparison Samples.

As is clear from the results shown in Table 2 above, it can be seen that the samples using the sensitizing dyes shown in this invention show very little change in sensitivity even when stored at a high temperature and high humidity for a long period of time.

EXAMPLE 2

A silver halide emulsion was prepared in the same manner as the case of preparing Emulsion A in Example 1 of U.S. Pat. No. 3,761,276. To the silver halide emulsion were added 1.4 mg of sodium thiosulfate and 2.1 mg of chloroauric acid per mol of silver in the emulsion, followed by heating to 60° C. for 30 minutes to provide a core shell emulsion, a pure silver bromide emulsion having a mean grain size of 0.8 micron (Emulsion A).

The core shell-type silver halide emulsion thus prepared was split into six parts, each having the same amount, and after adding each of the split emulsions, $3\times10^{-4}$ mol of each of Sensitizing Dyes (I-1), (I-8), (I-14) and (I-17) and Comparison Sensitizing Dye (A) shown in Example 1 and Comparison Sensitizing Dye (C) shown below per mol of the silver halide in the emulsion and 150 mg of Fogging Agent (II-2), 2-{4-[3-(4-chlorophenyl)ureido]phenyl}-1-formylhydrazine per mol of the silver halide, the mixture was coated on a polyethylene terephthalate support at a silver coverage of 4,000 mg/m$^2$ and a gelatin protective layer was formed thereon to provide Samples 2-1 to 2-6, respectively.

These samples were stored, exposed and developed as in Example 1, the results being shown in Table 3.

TABLE 3

| Sample No. | Sensitizing Dye | Sensitivity Change (a)* | Sensitivity Change (b)** |
|---|---|---|---|
| 2-1 | Sensitizing Dye (I-1) | −0.04 | −0.02 |
| 2-2 | Sensitizing Dye (I-8) | −0.07 | −0.01 |
| 2-3 | Sensitizing Dye (I-14) | +0.01 | −0.04 |
| 2-4 | Sensitizing Dye (I-17) | +0.02 | −0.02 |
| 2-5*** | Sensitizing Dye (A) | −0.14 | +0.11 |

TABLE 3-continued

| Sample No. | Sensitizing Dye | Sensitivity Change (a)* | (b)** |
|---|---|---|---|
| 2-6*** | Sensitizing Dye (C) | −0.10 | +0.07 |

(a)*After storing for 4 days at 50° C. and 10% RH.
(b)**After storing for 3 days at 25° C. and 90% RH.
***Comparison Sample.

As is clear from the results shown in Table 3, it can be seen that the photographic materials using the sensitizing dyes according to this invention show very little change in sensitivity even when the samples are stored under high temperature and high humidity for a long period of time. Furthermore, in comparison with the case of using Comparison Sensitizing Dye (C), it can be seen that the use of the sensitizing dyes according to this invention gives better results than the case of using the carboxyalkyl group-substituted dye.

Sensitizing Dye (C):

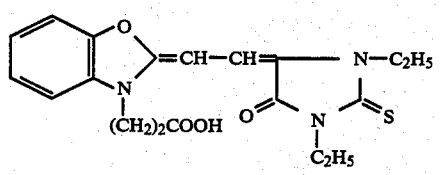

EXAMPLE 3

The silver halide emulsion having the same composition as in Example 2 was used. The silver halide emulsion was also split into six parts. After adding to each of the split emulsions $4\times10^{-3}$ mol of each of Sensitizing Dyes (I-25), (I-27), (I-34) and (I-36) and Comparison Sensitizing Dye (A) as shown in Example 1 and Comparision Sensitizing Dye (C) as shown in Example 2 per mol of silver and 150 mg of Fogging Agent (II-1), 1-formyl-2-[4-(3-phenylureido)phenyl]hydrazine per mol of the silver halide in the emulsion, each of the mixtures was coated on a polyethylene terephthalate support in the same manner as described above to provide Samples 3-1 to 3-6, respectively.

These samples were stored, exposed and developed under the same conditions as in the above examples, the results being shown in Table 4.

TABLE 4

| Sample No. | Sensitizing Dye | Sensitivity Change (a)* | (b)** |
|---|---|---|---|
| 3-1 | Sensitizing Dye (I-25) | 0 | −0.07 |
| 3-2 | Sensitizing Dye (I-27) | +0.03 | −0.06 |
| 3-3 | Sensitizing Dye (I-34) | +0.03 | −0.03 |
| 3-4 | Sensitizing Dye (I-36) | +0.03 | −0.04 |
| 3-5*** | Sensitizing Dye (A) | −0.12 | +0.11 |
| 3-6*** | Sensitizing Dye (C) | −0.09 | −0.08 |

(a)*After storing for 4 days at 50° C. and 10% RH.
(b)**After storing for 3 days at 25° C. and 90% RH.
***Comparison Sample As is clear from the results shown in Table 4, it can be seen that the photographic materials using the sensitizing dyes according to the invention show very little change in sensitivity even when the samples are stored at high temperature and high humidity for a long period of time.

EXAMPLE 4

A silver bromide emulsion was prepared by simultaneously mixing an equimolar amount of silver sulfate and potassium bromide for 20 minutes at 55° C. according to a controlled double jet method. After finishing precipitation, cubic crystals having a mean edge length of 0.1 micron formed. To the silver bromide thus formed were added 40 mg of sodium thiosulfate and 40 mg of chloroauric acid (tetrahydrate), each per mol of silver in the emulsion, followed by heating for 60 minutes at 75° C. to apply thereto chemical sensitization. To the silver bromide grains thus obtained as a core were added silver nitrate and potasssium bromide by a simultaneous mixing method to grow the silver halide crystals, whereby octahedral core-shell silver halide grains having a mean edge length of 0.25 micron were finally obtained. To the core-shell silver halide grains were added 3.4 mg of sodium thiosulfate and 3.4 mg of chloroauric acid (tetrahydrate) per mol of silver as surface sensitizers followed by heating for 60 minutes at 60° C. to provide an internal latent image-type direct positive silver halide emulsion.

The silver halide emulsion thus prepared was split into 6 parts as in Example 1, and after adding to each of the split emulsions $4\times10^{-3}$ mol of each of Sensitizing Dyes (I-8), (I-14), (I-27) and (I-34) and Comparison Sensitizing Dyes (A) and (C) per mol of silver in the emulsion and 230 mg of Fogging Agent (II-14), 2-{4-[3-(3-benzenesulfonamidophenyl)ureido]phenyl}-1-formylhydrazine per mol of silver, each of the mixture was coated on a polyethylene terephthalate support at a silver coverage of 2,500 mg/m$^2$, and further a gelatin protective layer was formed thereon to provide Samples 4-6 to 4-6, respectively.

These samples were stored, exposed, and developed as in Example 1, the results being shown in Table 5.

TABLE 5

| Sample No. | Sensitizing Dye | Sensitivity Change (a)* | (b)** |
|---|---|---|---|
| 4-1 | Sensitizing Dye (I-8) | −0.03 | +0.05 |
| 4-2 | Sensitizing Dye (I-14) | −0.02 | +0.04 |
| 4-3 | Sensitizing Dye (I-27) | −0.01 | +0.04 |
| 4-4 | Sensitizing Dye (I-34) | −0.03 | +0.06 |
| 4-5*** | Sensitizing Dye (A) | −0.05 | +0.13 |
| 4-6*** | Sensitizing Dye (C) | −0.03 | +0.10 |

(a)*After storing for 4 days at 50° C. and 10% RH.
(b)**After storing for 3 days at 25° C. and 90% RH.
***Comparison Sample As is clear from the results shown in Table 5, it can be seen that the photographic materials using the sensitizing dyes according to this invention show little change in sensitivity, particularly in the case of storing at high humidity.

While the invention has been described in detail and with reference to specific embodiments thereof, it will be apparent to one skilled in the art that various changes and modifications can be made therein without departing from the spirit and scope thereof.

What is claimed is:

1. A previously unfogged internal latent image direct positive silver halide emulsion containing at least one spectral sensitizing dye represented by formula (I):

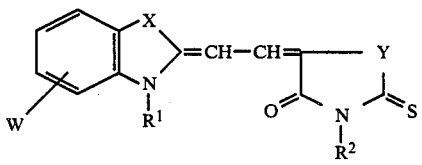

(I)

wherein one of $R^1$ and $R^2$ represents a sulfoalkyl group and the other thereof represents an unsubstituted or substituted alkyl group, an unsubstituted or substituted aryl group, or a pyridyl group; X represents a sulfur atom or an oxygen atom; Y represents a sulfur atom, an oxygen atom, or $$-\underset{|}{N}-R,$$

wherein R represents a lower alkyl group or $-(CH_2)_{n_1}O-(CH_2)_{n_2}OH$, wherein $n_1$ and $n_2$ each represents an integer of 1 to 4; and W represents a hydrogen atom, a halogen atom, a lower alkyl group, a lower alkoxy group, or an unsubstituted or substituted phenyl group.

2. An unfogged internal latent image direct positive silver halide emulsion as in claim 1, wherein the sulfoalkyl group represented by $R^1$ or $R^2$ has 4 or less carbon atoms.

3. An unfogged internal latent image direct positive silver halide emulsion as in claim 1, wherein the sulfoalkyl group represented by $R^1$ or $R^2$ is selected from the group consisting of a 2-sulfoethyl group, a 3-sulfopropyl group, and a 4-sulfobutyl group.

4. An unfogged internal latent image direct positive silver halide emulsion as in claim 1, wherein the sensitizing dye represented by formula (I) is used in a concentration of from about $1\times10^{-5}$ to $2\times10^{-3}$ mol per mol of silver halide.

5. A photographic material comprising a support having thereon at least one photographic layer containing a previously unfogged internal latent image direct positive silver halide emulsion containing at least one spectral sensitizing dye represented by formula (I):

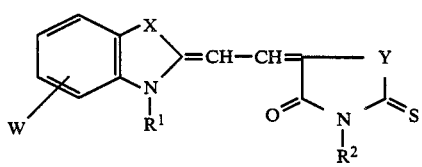

(I)

wherein one of $R^1$ and $R^2$ represents a sulfoalkyl group and the other thereof represents an unsubstituted or substituted alkyl group, an unsubstituted or substituted aryl group, or a pyridyl group; X represents a sulfo atom or an oxygen atom; Y represents a sulfur atom, an oxygen atom, or $$-\underset{|}{N}-R,$$

wherein R represents a lower alkyl group or $-(CH_2)_{n_1}O-(CH_2)_{n_2}OH$, wherein $n_1$ and $n_2$ each represents an integer of 1 to 4; and W represents a hydrogen atom, a halogen atom, a lower alkyl group, a lower alkoxy group, or an unsubstituted or substituted phenyl group.

6. A photographic material as in claim 5, wherein the sulfoalkyl group represented by $R^1$ or $R^2$ has 4 or less carbon atoms.

7. A photographic material as in claim 5, wherein the sulfoalkyl group represented by $R^1$ or $R^2$ is selected from the group consisting of a 2-sulfoethyl group, a 3-sulfopropyl group, and a 4-sulfobutyl group.

8. A photographic material as in claim 5, wherein the spectral sensitizing dye represented by formula (I) is used in a concentration of from about $1\times10^{-5}$ to $2\times10^{-3}$ mol per mol of silver halide.

9. A photographic material as claimed in claim 5, wherein said photographic material further contains a hydrazine compound as a fogging agent in said silver halide emulsion layer or in a hydrophilic colloid layer adjacent to said silver halide emulsion layer.

10. A photographic material as claimed in claim 9, wherein said hydrazine compound is represented by formula (II):

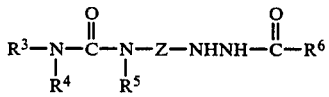

(II)

wherein $R^3$ and $R^4$, which may be the same or different, each represents a hydrogen atom, an aliphatic residue, an aromatic residue or a heterocyclic residue; $R^5$ represents a hydrogen atom or an aliphatic residue; $R^6$ represents a hydrogen atom, an aliphatic residue, or an aromatic residue; and Z represents a divalent aromatic residue.

11. A method of forming an image comprising imagewise exposing and developing a photographic material comprising a support having thereon at least one photographic layer containing a previously unfogged internal latent image direct positive silver halide emulsion containing at least one spectral sensitizing dye represented by formula (I):

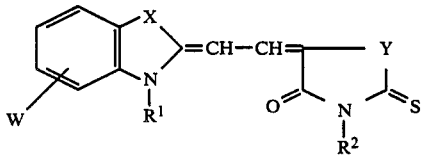

(I)

wherein one of $R^1$ and $R^2$ represents a sulfoalkyl group and the other thereof represents an unsubstituted or substituted alkyl group, an unsubstituted or substituted aryl group, or a pyridyl group; X represents a sulfo atom or an oxygen atom; Y represents a sulfur atom, an oxygen atom, or —N—R, wherein R represents a lower alkyl group or $-(CH_2)_{m_1}O-(CH_2)_{n_2}OH$, wherein $n_1$ and $n_2$ each represents an integer of 1 to 4; and W represents a hydrogen atom, a halogen atom, a lower alkyl group, a lower alkoxy group, or an unsubstituted or substituted phenyl group; wherein said photographic material is processed in the presence of a fogging agent.

12. A method as claimed in claim 11, wherein the sulfoalkyl group represented by $R^1$ or $R^2$ has four or less carbon atoms.

13. A method as claimed in claim 11, wherein the sulfoalkyl group represented by $R^1$ or $R^2$ is selected from the group consisting of a 2-sulfoethyl group, a 3-sulfopropyl group, and a 4-sulfobutyl group.

14. A method as claimed in claim 11, wherein the sensitizing dye represented by formula (I) is used in a concentration of from about $1\times10^{-5}$ to $2\times10^{-3}$ mol per mol of silver halide.

15. A method as claimed in claim 11, wherein said fogging agent is a hydrazine compound.

16. A method as claimed in claim 15, wherein said fogging agent is represented by the formula (II):

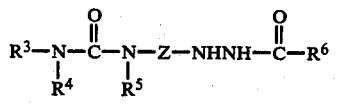

(II)

wherein $R^3$ and $R^4$, which may be the same or different, each represents a hydrogen atom, an aliphatic residue, an aromatic residue or a heterocyclic residue; $R^5$ represents a hydrogen atom or an aliphatic residue; $R^6$ represents a hydrogen atom, an aliphatic residue, or an aromatic residue; and Z represents a divalent aromatic residue.

17. A method as claimed in claim 11, wherein said fogging agent is contained in silver halide emulsion layer or in a hydrophilic colloid layer adjacent to said silver halide emulsion layer.

* * * * *